US005713481A

United States Patent [19]

Jordan

[11] Patent Number: 5,713,481

[45] Date of Patent: Feb. 3, 1998

[54] FULL PANEL PULL OUT CAN END WITH VENT MEANS

[75] Inventor: Charles L. Jordan, New Kensington, Pa.

[73] Assignee: Aluminum Company of America, Pittsburgh, Pa.

[21] Appl. No.: 643,907

[22] Filed: May 6, 1996

[51] Int. Cl.[6] ..... B65D 17/34

[52] U.S. Cl. ..... 220/271; 220/270; 220/276; 220/359

[58] Field of Search ..... 220/269, 270, 220/271, 276, 359

[56] References Cited

U.S. PATENT DOCUMENTS

| | | | |
|---|---|---|---|
| 3,477,608 | 11/1969 | Fraze . | |
| 3,604,589 | 9/1971 | Fraze . | |
| 3,655,091 | 4/1972 | La Croce . | |
| 3,656,652 | 4/1972 | Khoury . | |
| 3,662,916 | 5/1972 | Holk, Jr. . | |
| 3,720,348 | 3/1973 | Jakobsen . | |
| 3,771,688 | 11/1973 | Frankenberg et al. | 220/271 |
| 3,780,902 | 12/1973 | Holo et al. . | |
| 3,785,522 | 1/1974 | Prayer et al. . | |
| 4,182,460 | 1/1980 | Holk, Jr. et al. | 220/271 |
| 4,215,791 | 8/1980 | Brochman | 220/258 |
| 4,405,056 | 9/1983 | Patterson | 220/271 |
| 4,705,186 | 11/1987 | Barrash . | |
| 4,872,597 | 10/1989 | Hanafusa | 220/276 X |
| 4,928,845 | 5/1990 | Doyle . | |
| 5,038,956 | 8/1991 | Saunders | 220/271 |

*Primary Examiner*—Stephen Cronin
*Attorney, Agent, or Firm*—David W. Brownlee

[57] ABSTRACT

A full panel pull out easy opening end having vent means which includes at least one vent hole adjacent the pull tab and a strip of tape over the vent hole and over the handle end of the tab so the tab cannot be easily lifted without first at least partially removing the tape over the vent hole.

12 Claims, 2 Drawing Sheets

FULL PANEL PULL OUT CAN END WITH VENT MEANS

FIELD OF THE INVENTION

The invention pertains to easy opening containers of the full panel pullout type wherein the wall of the container has a rupturable score defining a relatively large removable panel and a tab is connected to the removable panel to serve as lever means for initiating severance along the rupturable score and which includes means for venting the container prior to rupture of the score.

BACKGROUND OF THE INVENTION

It is known to provide full panel ends which include a score line around a relatively large panel and a tab having the handle end which is lifted to rupture the score line and remove the panel portion of the end. The working end of the tab fulcrums against the container wall to initiate severance of the panel, whereafter, the user pulls on the tab to tear the panel away from the container wall. Tabs of this type are commonly known as front opening tabs. Examples of such can ends are disclosed in U.S. Pat. Nos. 3,606,076; 3,655,091; 3,656,652; 3,662,916; 3,780,902 and 3,785,522.

Containers of this type are commonly used on products which are maintained at a pressure which is substantially below atmospheric pressure. There is a need for containers of this type for use on products which are maintained at pressures substantially above atmospheric pressure. If the container is maintained at substantially above atmospheric pressure, the container should be vented to permit equalization across the container wall prior to severance of the tear strip thereby to prevent any possibility of the tear strip being projected away from the container at high velocity in a hazardous manner. Another problem to which the invention is directed relates to spraying of the containers contents when the end is first vented. For example, ground coffee packed in easy opening containers of the full panel pullout type is often sprayed on the consumer when the containers are opened.

It is important to provide adequate assurance that the container is effectively vented before severance of the tear panel is initiated. Some examples of vent means for full panel pull containers are disclosed in U.S. Pat. Nos. 3,477,608; 3,604,589; 3,720,348; 4,705,186 and 4,928,845 among others. An improved can lid and can assembly are needed which will provide the desired assurance of proper venting.

SUMMARY OF THE INVENTION

With reference to the need for an improved vent for a full panel can end, this invention provides a vent hole which is sealed by a strip of material over the hole which must be removed before the pull tab can be lifted to remove the panel. The strip is secured over the handle end of the tab to prevent lifting of the tap without first venting the can.

This invention teaches that the need for adequate preliminary venting of the container in advance of severance of the tear panel may be insured by such a vent hole and sealing strip. The sealing strip has a free end that can be gripped by the user's fingers to pull and remove the strip from over the vent hole and from over the handle end of the tab.

It is apparent that the total or cumulative effect of these features is to insure that the pressure differential across the container wall is reduced to zero before severance of the tear panel is initiated.

The features and advantages of the invention may be understood from the following detailed description and the accompanying drawings.

BRIEF DESCRIPTION OF THE DRAWINGS

In the drawings, which are to be regarded as merely illustrative.

DESCRIPTION OF PREFERRED EMBODIMENTS OF THE INVENTION

As used herein, the words "upwardly", "downwardly", "inwardly", "outwardly", "horizontally", "vertically" and the like are with reference to a can and a lid or easy opening end wall on the can which is disposed in an upright position.

Figure 1:
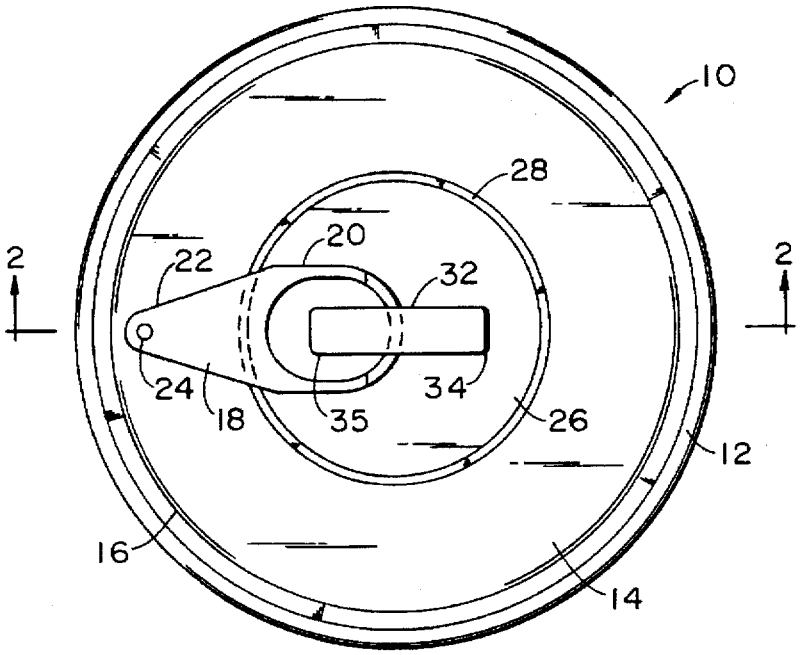
FIG. 1 is a plan view of a can end incorporating a preferred embodiment of the invention.
Figure 2:
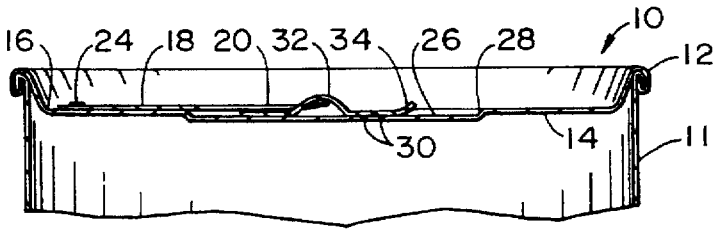
FIG. 2 is a cross-section through the can end of FIG. 1 as indicated by the line 2—2 of FIG. 1 and showing the can end on a filled and sealed can.

FIGS. 1 and 2 show a preferred embodiment of a full panel pull out easy opening end or lid 10 having a vent means provided therein in accordance with this invention. Full panel pull out easy opening ends are well known in the art and may be of a great variety of shapes and sizes such as those shown in U.S. Pat. Nos. 3,655,091; 3,656,652; and 3,662,916, the teachings of which are incorporated herein by reference. The particular configuration of the end shell, score line and tab are not critical to this invention, except that the tab is preferably a ring pull tab as described below. FIG. 2 shows the lid 10 double seamed on a can 11.

The lid 10 can be made of a variety of materials such as steel or aluminum, but is preferably made of aluminum alloy sheet material such as 5042 alloy in intermediate to hard temper. The lid 10 has a peripheral flange 12 by which the lid can be assembled with a cylindrical can body 11. The flange 12 forms part of the usual chuck wall or chime of the finished can. For purposes of providing a relatively large removable circular tear panel 14, the lid 10 is weakened by a circular score 16 that lies close to the peripheral flange 12. The score 16 is impressed into the outer face of the lid.

A metal tab 18, preferably made of aluminum alloy and having a handle end 20 and an opposite working or fulcrum end 22 as well known in the art, is provided for rupturing the score 16. The tab 18 is connected to the tear panel 14 by an integral rivet 24 formed from the metal in the lid as is also well known in the art. The rivet 24 extends through a circular operative in the fulcrum end 22 of tab. The handle end 20 is preferably ring-shaped with an open center within the ring portion.

The lid 10 preferably has a depressed concentric area in the form of a depression 26 surrounded by an offset shoulder 28. The depression 26 provides clearance under the handle end 20 of the tab to facilitate gripping the tab, and the shoulder 28 helps to stiffen the can end.

A feature of this invention is the provision of a vent that must, almost invariably, be opened before the tab 18 can be lifted to rupture the score 16 and remove the tear panel 14. In accordance with this invention, at least one small vent hole 30 is provided in the tear panel 14 adjacent the tab 18, and a sealing and retaining means 32 is bonded to the tear panel over the vent hole or holes 30 and a portion of the tab 18. The sealing and retaining means is preferably a strip of tape 32 which is bonded to the tear panel 14 in such a way as to overlie a portion of the pull tab to effectively preclude, or at least effectively discourage, lifting of the tab without first stripping the tape from the tear panel over the vent hole or holes 30.

A preferred embodiment of this invention includes a pull tab 18 which has a ring-shaped handle end 20, and the tape 32 is secured to the tear panel 14 within the ring and also outside the ring and overlies a portion of the ring. The vent hole(s) 30 in the tear panel may be within the ring, outside the ring, or in both locations.

Figure 3:
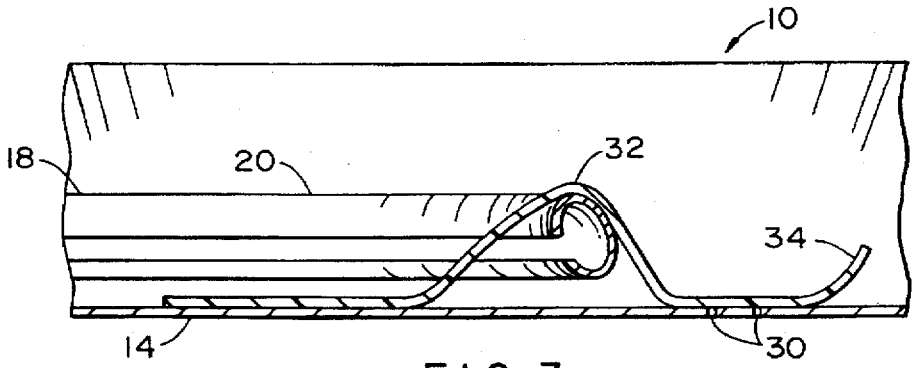
FIG. 3 is an enlarged fragment of FIG. 2 showing the sealing strip over the handle end of the tab and the vent holes in the end.
Figure 4:
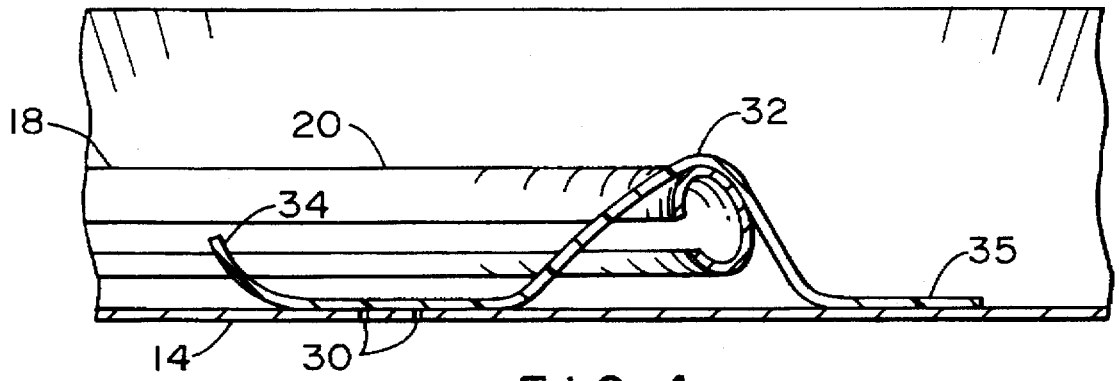
FIG. 4 is an enlarged fragmentary cross-sectional view similar to FIG. 3 and showing an alternative embodiment of the invention.

The tape 32 preferably has only one free end 34 which can be easily gripped by the consumer to pull the tape and break at least part of its bond to the tear panel 14. The free end 34 is preferably on the same side of the ring 20 as are the vent holes 30. Thus, if the free end 34 is outside the pull ring 20, the vent hole(s) 30 should be under the tape outside the ring as shown in FIGS. 1–3. Conversely, if the free end 34 of the tape 32 is within the ring 20, the vent hole(s) 30 should be in the tear panel within the ring as shown in FIG. 4. The tape is bonded to the tear panel over the full area of the tape except for the free end 34 such that gripping the tape to pull it from the tear panel as at the other end 35 is very difficult except by gripping the free end 34. Thus, the consumer will be essentially precluded from lifting the pull tab without first separating the tape from over the vent hole 30 and thereby freeing the pull tab from being held down by the tape.

The tape 32 can be made of a variety of materials such as polyester strip material or a laminate of materials such as polyester and metal foil. The tape is preferably bonded to the tear panel with pressure sensitive adhesive but can also be bonded to the panel with heat seal adhesive or bonding agents. The adhesive must have a peel and shear strength sufficient to prevent separation of the tape from the tear panel by internal pressure in a can to which the end is affixed, but not so strong as to make separation of the bond unreasonably difficult for the consumer.

The vent hole or holes 30 are preferably relatively small to essentially preclude particles of food, coffee or other condiments or materials from escaping therethrough and also to minimize the force against the tape 32 from the internal pressure in the can on which the lid is secured. The cross-sectional diameter, or transverse extent if other than round, of the vent holes 30 should preferably be in a range of 1/16 to 1/32 inch or smaller depending on the contents of the can. It is also desirable to provide more than one vent hole in case one or more happens to become plugged.

Figure 5:
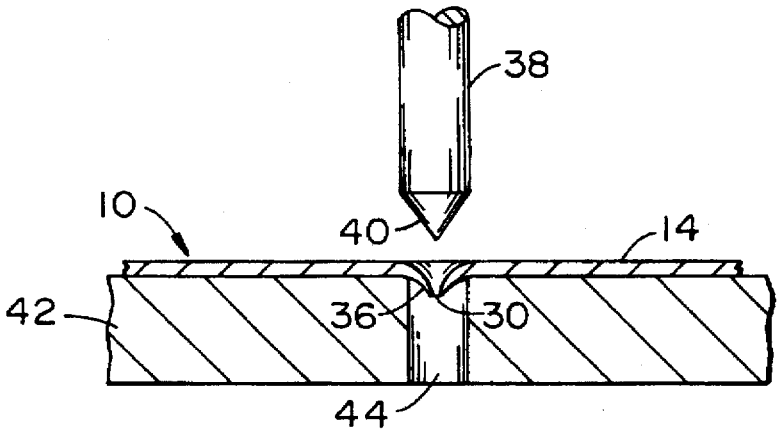
FIG. 5 is a fragmentary cross-sectional view showing tools for forming small vent openings in a can end of this invention.

FIG. 5 shows tools for making a vent hole 30 in a tear panel 14 and a small dimple 36 around the hole which helps prevent the contents of a container from being propelled through the hole with escaping gas. As shown in that FIG. 5, a hole is pierced in a can lid 10 by a punch 38 having a pointed end 40 and a supporting die 42 having a round die opening 44 which is larger than the pointed end of the punch so the metal of the lid will be caused to bulge downwardly by the punch as the small hole 30 is pierced in the metal of the lid. Alternative tools for making either round or non-round holes will be apparent to those skilled in the art.

It is therefore seen that this invention provides a full panel pull out easy opening end and container having an improved vent means which avoids or minimizes spraying of the container's contents and missling of the tear panel upon opening. The container may have a plastic cover cap removably secured over the easy opening end for use as a reclosure after the pull out panel has been removed. Such cover caps are well known in the art.

The description herein of specific detail of the presently preferred embodiments will suggest various changes, substitutions and other modifications within the scope of the invention and the claims appended hereto. For example, vent holes could be provided in a lid both within and outside the ring on the pull tab, and the sealing and retaining strip over the holes could have both ends free to be gripped by the consumer. The vented end of this invention can also be used in vacuum packed products to ensure venting of air into the container before the tab is lifted to rupture the score line around the removable panel. The invention could also be used on a pressurized beverage end to insure venting of the end before the score line is ruptured to remove the tear strip for a pour opening.

What is claimed is:

1. An easy opening end wall for a pressurized container, said end wall having:

a score line therein defining a relatively large full panel pull-out portion to facilitate removal of ground coffee, foods or non-food contents which is adapted to be at least partially separated from the end wall;

a pull tab attached to the end wall which is adapted to be lifted and pulled to rupture said score line and at least partially separate the pull-out panel from the end wall;

at least one vent hole in said end wall; and sealing and retaining means adhered to said end wall overlying said vent hole and sealing it against ingress or egress of product or gases therethrough and also overlying a portion of said pull tab, said sealing and retaining means having a free end which is adapted to be gripped and pulled to disengage such means from said end wall overlying said vent hole and release said pull tab so it can be lifted to rupture said score line, whereby said pull tab is restrained against being lifted without first venting the pressure in a can on which the end wall is sealed.

2. An easy opening end wall as set forth in claim 1 in which said vent hole is disposed in a dimple in said end wall which projects toward the interior of a can on which the end wall is secured.

3. An easy opening end wall as set forth in claim 1 which includes a plurality of vent holes each of which has a transverse extent less than about 1/16 inch.

4. An easy opening end wall as set forth in claim 3 in which each said vent hole has a transverse extent less than about 1/32 inch.

5. In an easy opening end wall of a container having an internal pressure substantially different from atmospheric pressure wherein a rupturable line of weakness defines an at least partially removable tear panel and wherein a pull tab of sheet metal has a ring shaped handle end with an open center and has a working end overhanging the tear panel to fulcrum against the tear panel to initiate severance of the tear panel, said tab being attached to the tear panel intermediate the two ends of the tab, an improvement comprising means for venting the container prior to initial rupture of said line of weakness, said means comprising:

at least one vent hole in said end wall adjacent said handle end of the tab and a strip of substantially impermeable tape overlying at least a portion of handle end of said tab and adhesively bonded to said end wall over said at least one venting hole to seal the same, said strip being adhesively bonded to said end wall within said open center of said handle end of the pull tab and having a free end which is adapted to be gripped and pulled to disengage the tape from over said vent hole and release the handle end of said tab whereafter said pull tab can be lifted to rupture said line of weakness.

6. An improvement as set forth in claim 5 in which said easy opening end wall is made of an aluminum alloy.

7. An improvement as set forth in claim 5 in which said easy opening end is assembled and sealed on a pressurized can.

8. An improvement as set forth in claim 5 which includes a plurality of small vent holes which are sealed by said strip of substantially impervious tape.

9. An improvement as set forth in claim 8 in which said vent holes are less than 1/32 inch in cross-sectional extent.

10. An easy opening lid for a pressurized container comprising an end wall having a peripheral flange around it for attachment to a container, said end wall having a score line therein defining a removable portion, a pull tab attached to said removable portion with said pull tab including a handle end in the form of a ring, at least one vent hole in the removable portion under or adjacent the pull tab and a strip of tape adhesively bonded to the removable portion over the vent hole and over a portion of said ring on the tab so the tab cannot be easily lifted without first at least partially removing said strip over said vent hole.

11. An easy opening end wall for a pressurized container, said end wall having:

a score line therein defining a relatively large tear panel portion which is adapted to be at least partially separated from the end wall;

a pull tab attached to the end wall having a ring shaped handle end portion which is adapted to be lifted and pulled to rupture said score line and at least partially separate the tear panel from the end wall;

at least one vent hole in said end wall adjacent said pull tab; and sealing and retaining means comprising a strip of tape bonded to said end wall overlying said vent hole and sealing it against ingress or egress of product or gases therethrough and also secured to said end wall within said ring portion and overlying a portion of said pull tab, said sealing and retaining means having a free end adjacent said vent opening which is adapted to be gripped and pulled to disengage such means from said end wall overlying said vent hole and release said pull tab so it can be lifted to rupture said score line, whereby said pull tab is restrained against being lifted without first venting the pressure in a can on which the end wall is sealed.

12. An easy opening end wall for a pressurized container, said end wall having:

a score line therein defining a relatively large tear panel portion which is adapted to be at least partially separated from the end wall;

a ring shaped pull tab attached to the end wall which is adapted to be lifted and pulled to rupture said score line and at least partially separate the tear panel from the end wall;

at least one vent hole in said end wall in said tear panel portion inside said ring pull tab; and sealing and retaining means comprising a strip of tape bonded to said end wall overlying said vent hole and sealing it against ingress or egress of product or gases therethrough and also overlying a portion of said pull tab, said strip of tape having a free end on the end thereof which is bonded to the tear panel inside said ring pull tab and which is adapted to be gripped and pulled to disengage such means from said end wall overlying said vent hole and release said pull tab so it can be lifted to rupture said score line, whereby said pull tab is restrained against being lifted without first venting the pressure in a can on which the end wall is sealed.

* * * * *